US006925980B2

(12) United States Patent
Glovatsky

(10) Patent No.: US 6,925,980 B2
(45) Date of Patent: Aug. 9, 2005

(54) INTEGRATED POWERTRAIN CONTROL SYSTEM FOR LARGE ENGINES

(75) Inventor: Andrew Z. Glovatsky, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 107 days.

(21) Appl. No.: 10/070,645

(22) PCT Filed: Jul. 26, 2001

(86) PCT No.: PCT/US01/23482

§ 371 (c)(1),
(2), (4) Date: Jul. 2, 2002

(87) PCT Pub. No.: WO02/10587

PCT Pub. Date: Feb. 7, 2002

(65) Prior Publication Data

US 2002/0179025 A1 Dec. 5, 2002

Related U.S. Application Data

(60) Provisional application No. 60/221,062, filed on Jul. 27, 2000.

(51) Int. Cl.[7] ..... F01P 1/06
(52) U.S. Cl. ..... 123/184.21; 123/184.61
(58) Field of Search ..... 123/184.21–184.61, 123/198 E, 195.5, 41.31

(56) References Cited

U.S. PATENT DOCUMENTS 3,980,053 A * 9/1976 Horvath ..... 123/3
3,996,914 A * 12/1976 Crall et al. ..... 123/198 E
4,926,821 A * 5/1990 Porth et al. ..... 123/399
5,311,398 A * 5/1994 Schirmer et al. ..... 361/704
5,988,119 A * 11/1999 Trublowski et al. ..... 123/41.31
6,186,106 B1 2/2001 Glovatsky et al.
6,279,527 B1 8/2001 Glovatsky et al.
6,357,414 B1 * 3/2002 Kalinowski et al. .... 123/198 E
6,408,811 B1 * 6/2002 Glovatsky et al. ..... 123/184.61
6,415,757 B1 * 7/2002 Glovatsky ..... 123/195 C
6,484,708 B2 * 11/2002 Hirakawa et al. ..... 123/647
6,494,174 B1 * 12/2002 Daly ..... 123/143 C
6,494,186 B1 * 12/2002 Wakeman ..... 123/479
6,675,755 B2 * 1/2004 Glovatsky et al. ..... 123/143 C

* cited by examiner

*Primary Examiner*—Marguerite McMahon
(74) *Attorney, Agent, or Firm*—Brinks Hofer Gilson & Lione

(57) ABSTRACT

An integrated manifold assembly (500) for routing electrical signals in an internal combustion engine is disclosed. The assembly includes an air-intake manifold (506) for drawing fresh air into the internal combustion engine, a main circuit portion (508) fixable to the air-intake manifold (506) of the internal combustion engine, a plurality of circuit runner portions (510) extending from the main circuit portion (508) for interconnecting the main circuit portion (508) with a plurality of engine components (512, 514), and a heat sink (517) affixed to the air-intake manifold (506) and in contact with at least one of the a main circuit portion (508) and the plurality of circuit runner portions (510) for dissipating heat generated in the circuit portions.

6 Claims, 12 Drawing Sheets

INTEGRATED POWERTRAIN CONTROL SYSTEM FOR LARGE ENGINES

CROSS-REFERENCE TO RELATED APPLICATIONS

The present invention claims priority to U.S. Provisional Application Ser. No. 60/221,062, filed on Jul. 27, 2000 and entitled "Integrated Electronic Powertrain Control Manifold Design".

FIELD OF THE INVENTION

The present invention relates to vehicle powertrains having integrated powertrain control systems mounted on the powertrain.

BACKGROUND ART

Typically engines, such as internal combustion engines, have an air intake manifold 50 for drawing in air from outside the engine 30 and directing the air into each engine cylinder 32 as illustrated in FIG. 1. The outside air flows in through an air intake duct 56 and into a central air chamber, from which it is then directed into individual runners or channels 54 and into each individual engine cylinder where combustion takes place.

Generally, combustion is facilitated by activating a spark from a spark plug within the cylinder 32 of a gasoline engine or by activation of a glow plug within the cylinder of a diesel engine. Such activation is generally accomplished by supplying either pulsed or continuous electrical signals or power feeds to the spark plug or glow plug. These signals or power feeds in turn typically come from either a central distributor, or from individual ignition coils 34 at each cylinder. In fuel injected engines, it may also be desirable to have an individual electronic fuel injector (EFI) 94 disposed approximate each cylinder and fed by a fuel rail 36; these EFI's also require signals or power feeds, typically from a microprocessor-controlled sub-system 38.

The electrical distribution system required to facilitate these various signals and or power feeds conventionally requires a considerable network of wires 42, cables, harnesses, connectors, fasteners, brackets, standoffs, strain reliefs, and one or more support frames for arranging, routing, and supporting all of these elements. In addition, most engines nowadays also require various other electrical engine sub-systems 44, such as engine control modules, mass air flow sensors, sensor modules, antilock brake control modules, and so forth. Each of these sub-systems also require its associated wires, harnesses, connectors, housings, fasteners, etc. further adding to the electrical distribution and routing system of the engine. All of these various sub-systems are necessary, they may each add to the overall weight, space, complexity and cost of the engine.

Therefore, it would be desirable to provide some means of accommodating the various signals and power feed needs of an engine system by reducing the overall weight, space requirements, cost, and complexity of the engine system.

SUMMARY OF THE INVENTION

The present invention overcomes the disadvantages of the prior art approaches by providing an system for controlling the operation of a vehicle powertrain. The system has a powertrain circuit for receiving powertrain a plurality of operating signals, processing the operating signals, and outputting a plurality of powertrain control signals for controlling the vehicle powertrain, and an air-intake manifold fixable to an engine of the vehicle powertrain and adapted to receive the powertrain control circuit.

In accordance with an embodiment of the present invention the powertrain circuit is a flatwire flexible circuit.

In accordance with another embodiment of the present invention the flatwire flexible circuit includes a flatwire lead for electrically coupling the powertrain circuit to an external device or circuit.

In accordance with yet another embodiment of the present invention an integrated manifold assembly for routing electrical signals in an internal combustion engine is provided. The assembly includes an air-intake manifold for drawing fresh air into the internal combustion engine, a main circuit portion fixable to the air-intake manifold of the internal combustion engine, a plurality of circuit runner portions extending from the main circuit portion for interconnecting the main circuit portion with a plurality of engine components, and a heat sink affixed to the air-intake manifold and in contact with at least one of the a main circuit portion and the plurality of circuit runner portions for dissipating heat generated in the circuit portions.

In accordance with yet another embodiment of the present invention the air-intake manifold is substantially comprised of plastic.

In accordance with yet another embodiment of the present invention the heat sink is comprised of a thermally conductive material.

In accordance with yet another embodiment of the present invention the main circuit portion further comprises a flexible substrate for supporting electrical conductors and electrical devices.

In accordance with yet another embodiment of the present invention the main circuit portion further comprises a flexible substrate and a rigid substrate for supporting electrical conductors and electrical devices.

In accordance with yet another embodiment of the present invention the main circuit portion is in contact with the heat sink affixed to the air-intake manifold.

In accordance with yet another embodiment of the present invention the plurality of circuit runner portions are in contact with the heat sink affixed to the air-intake manifold.

In accordance with yet another embodiment of the present invention the main circuit portion and the plurality of circuit runner portions are in contact with the heat sink affixed to the air-intake manifold.

In accordance with yet another embodiment of the present invention the assembly further comprises a plurality of electrical conductors and a plurality of electrical devices wherein the plurality of electrical devices are mounted on the main circuit portion and the plurality of electrical conductors are affixed to the main circuit portion and the plurality of circuit runner portions.

In accordance with yet another embodiment of the present invention the assembly further comprises a plurality of electrical conductors and a plurality of electrical devices wherein the plurality of electrical devices and the plurality of electrical conductors are mounted throughout the main circuit portion and the plurality of circuit runner portions.

In accordance with yet another embodiment of the present invention an integrated air-intake and circuit assembly for routing electrical signals in an internal combustion engine is provided. The assembly has an air-intake manifold for drawing fresh air into the internal combustion engine, a throttle body affixed to the air-intake manifold and in fluid communication therewith for regulating air induction into the internal combustion engine, a main circuit portion fixable to the throttle, a plurality of circuit runner portions extending from the main circuit portion for interconnecting the main circuit portion with a plurality of engine components, and a heat sink affixed to the throttle body and in contact with at least one of the a main circuit portion and the plurality of circuit runner portions for dissipating heat generated in the circuit portions.

These and other advantages, features and benefits of the invention will become apparent from the drawings, detailed description and claims which follow.

DETAILED DESCRIPTION OF THE PREFERRED EMBODIMENTS

Figure 3:
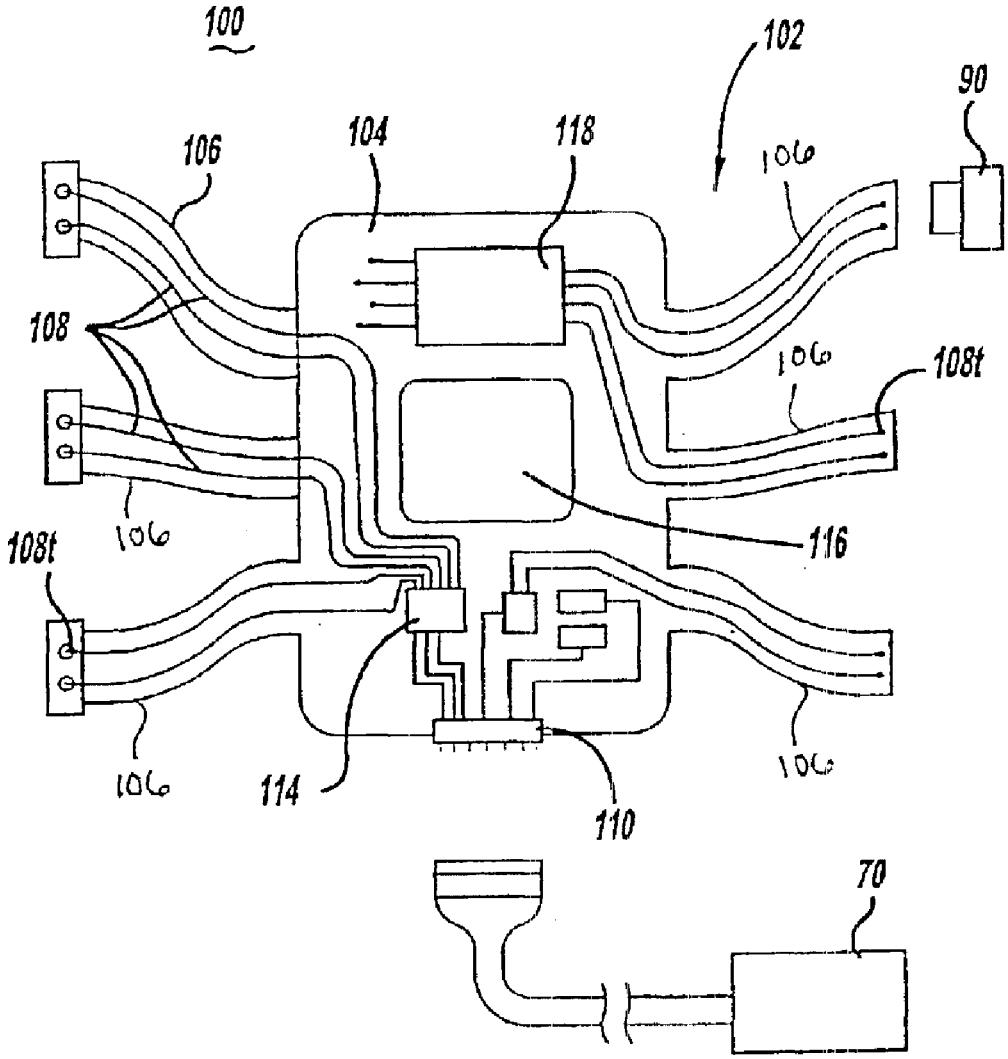
FIG. 3 is a top view of a flexible/semi-flexible circuit for controlling various automotive systems according to an embodiment of the present invention.
Figure 4:
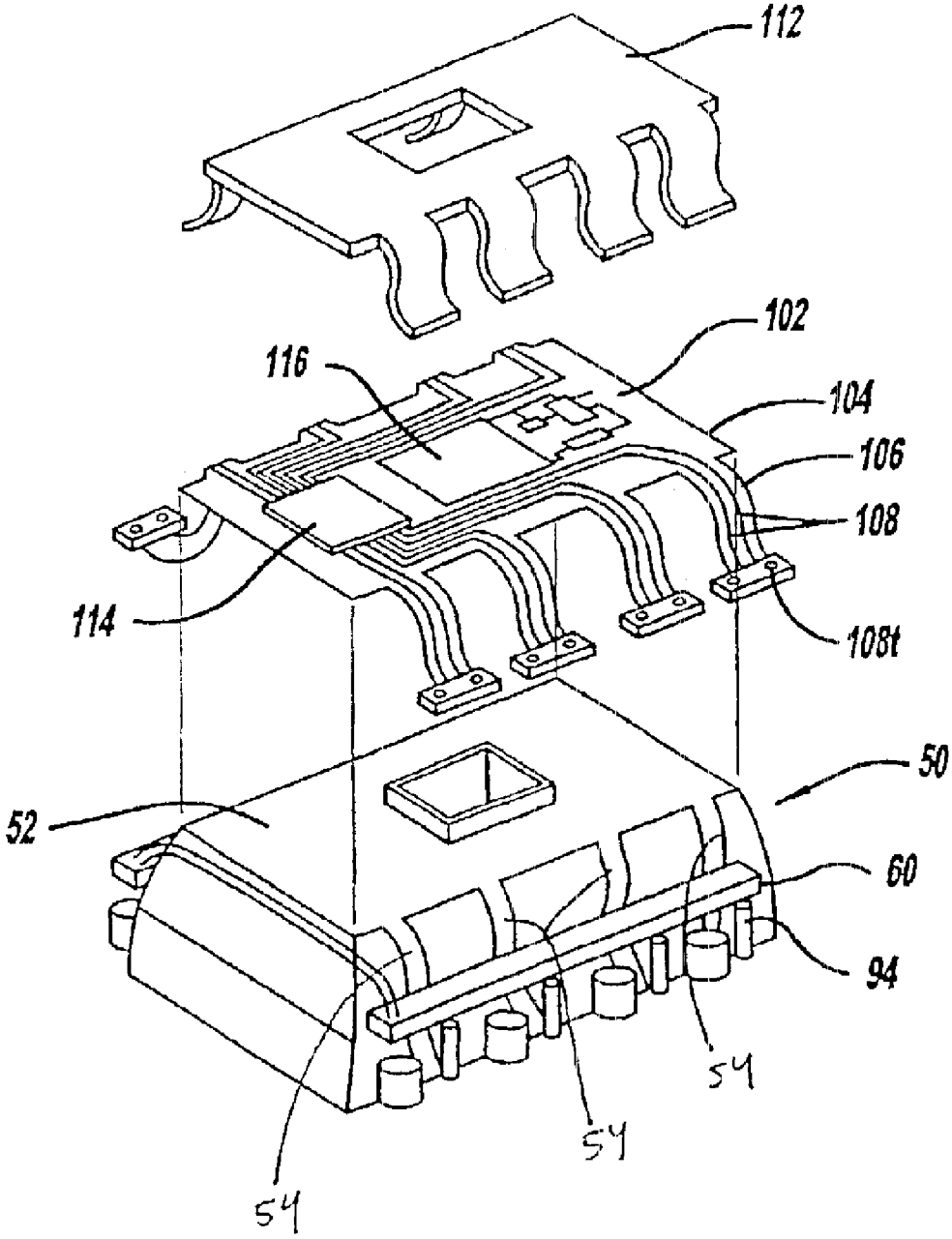
FIG. 4 is an exploded view of a flexible circuit and air intake manifold assembly in accordance with an embodiment of the present invention.

Referring now to the drawings, FIGS. 3–4 show an embodiment 100 of the present invention, namely a flex circuit for routing electrical signals in an internal combustion engine (not shown) having a plurality of cylinders and an intake manifold 50. This embodiment includes: (1) a flex circuit substrate 102 having a body portion 104 and at least n arm portions 106 extending outward from the body portion, wherein the body portion generally conforms in shape with a top surface 52 of the intake manifold 50, and wherein each arm portion is arranged in general proximity with a respective cylinder; (2) a plurality of conductive circuit traces 108 arranged proximate (i.e., on or beneath/within) at least one surface of the body portion 104 and of each arm portion 106; and (3) at least one input/output connector 110 for connection to at least one of an external signal source, an external power source, an external signal destination, and an external power destination (collectively designated by reference numeral 70), wherein each input/output connector 110 is attached to the substrate 102 and is electrically connected to at least one of the circuit traces 108. In this embodiment, each circuit trace carried by each arm portion 106 terminates in a termination 108*t* capable of electrical connection with at least one electrical engine element 90, such as an ignition coil, an electronic fuel injector, a spark plug, and/or a glow plug. Further, the present embodiment may include a fuel rail 60 secured to manifold 50 for feeding fuel to injectors 94.

The substrate 102 is preferably a substantially flexible substrate, such as a film, sheet, or lamination of polyetherimide, polyester, or other materials used to make flex circuits. Alternatively, the substrate 102 may comprise one or more metal foils or sheets with one or more layers of insulative, conductive, and/or dielectric material selectively applied thereto (e.g., by lamination, etching, or other additive or subtractive processes). Although the substrate 102 is preferably generally flexible, the body portion 104 may alternatively include at least one rigid substrate portion 118 (e.g., an FR-4 daughter board) operably connected to the remaining flexible body portion and/or arm portions. Likewise, the entire body portion 104 may comprise a rigid substrate, to which flexible substrate arm portions 106 are operably attached.

The substrate 102 may include a plurality of electronic components 114 operably attached to the circuit traces 108 thereon. These components 114 are preferably surface mount components, such as integrated circuit (IC) chips, leadless chip components (LCCs) such as resistors and capacitors, power devices, interconnect devices, microprocessors and the like. It is possible to take components from otherwise separate electronic control modules—including but not limited to engine control modules, mass air flow sensor modules, anti-lock brake control modules, speed control modules, throttle control modules, fuse box modules, exhaust gas return (EGR) valve control modules, engine temperature sensor control modules and integrate the components onto the flex substrate 102 of the present embodiment. This would provide the advantage of eliminating the various housings, wires, cables, harnesses, busses, interconnects, fasteners, etc. that are otherwise needed for each individual module and incorporating only the necessary parts therefrom (i.e., the electronic components) onto the flex substrate 102, thereby reducing cost, weight, space, and complexity for the overall powertrain system. Thus, the present invention provides a system and method for controlling the operation of a powertrain wherein the powertrain control electronics (PCE) are packaged integral with the powertrain or, more specifically, within the air intake manifold of the engine.

The substrate 102 may further include a hole 116 in the body portion 104 thereof, through which a top portion of the intake manifold 50 or an end portion of an air intake duct 56 may extend. The substrate 102 may also be removably attachable to the top surface 52 of the intake manifold 50. This may be accomplished, for example, by providing holes in the substrate 102 through which fasteners may be inserted for holding the substrate against the manifold, or by providing fasteners (such as pushpins) integral with the substrate which directly attach to the manifold.

Figure 5:
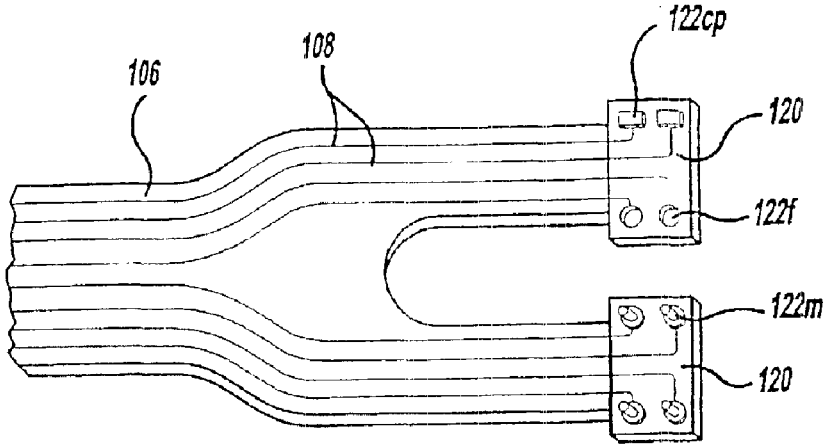
FIG. 5 is a top view of an arm portion and terminates in accordance with an embodiment of the present invention.

Each arm portion 106 may include a rigid substrate member 120 on an end thereof, wherein the termination of each circuit trace 108 on each arm portion 106 is disposed on the rigid substrate member 120, as illustrated in FIG. 5. Also, each circuit trace termination 108*t* on each arm portion 106 may comprise a male plug connector 122*m*, a female socket connector 122*f*, or a generally flat contact pad 122*cp*. These plug connectors 122*m*/122*f* may optionally be attached to or made integral with the rigid substrate member 120 on the end of each arm portion 106.

The conductive circuit traces 108 may be similar to those found on conventional rigid PCBs and flex circuits, such as the metallizations or paths of copper or conductive ink applied to one or both planar sides of such substrates. The traces 108 may also comprise wires or other electrical conductors applied to a surface of the substrate 102, or which are embedded, molded, or otherwise placed beneath a surface of the substrate (i.e., within the substrate).

The input/output (i/O) connector 110 is used to connect one or more substrate circuit trace(s) 108 (typically multiple traces) to one or more external electrical elements 70. From the perspective of current flow within the engine's electrical system, these external elements 70 may each be an "upstream" source or a "downstream" destination (or both) with respect to the i/O connector 110. The electrical flow to or from each of these external elements to which the i/O connector is connected may be generally designated as "signal" strength (e.g., milliamps, millivolts) or "power" strength (e.g., 1+amps, 1+volts). Thus, an external "power source" might be a 12-volt battery, a "power destination" might be a solenoid requiring several amps/volts to actuate, a "signal source" might be a 150-millivolt output from a microprocessor, and a "signal destination" might be a 150-millivolt input to the same microprocessor. Furthermore, it should be understood that the electrical flow into and out of the i/O connector 110 may at any time be continuous, intermittent/pulsed, or both. The i/O connector 110 itself may assume any of the multitude of different i/O connector configurations known in the art which can be operably connected to a flexible, semi-rigid/rigiflex, or rigid substrate 102.

The present embodiment may also include a cover 112 capable of covering substantially all of body portion 104 and at least part of each arm portion 106, as shown in FIG. 4. This cover 112 may be made out of plastic, metal, fiberglass, and the like (or combinations thereof), may be removably attachable to intake manifold 50, and serves as a protective covering for the underlying substrate, traces, etc. Cover 112 may include a generally sealable hole therein through which the top portion of the manifold or an end portion of the air intake duct may extend.

In its most basic form, the present embodiment 100 may be used to replace the wires, cables, harnesses, support frame(s), powertrain control circuits and other related elements used in conventional powertrain control systems for routing and distributing electrical signals to control the engine's ignition coils, EFIs, spark plugs, glow plugs, and/or other electrical engine elements 90, as well as, the vehicle's transmission, thus reducing cost, space, weight, and complexity for the overall engine system. By further including the electronic components from one or more engine control modules as described above, further reductions can be realized. Moreover, the savings and reductions made possible by the present invention relate not only to the initial manufacturing and assembly of the powertrain system, but also to the maintenance and service life of the powertrain system as well. As an example of how the present embodiment might be used, the flex circuit 100 might contain electronic components (including microprocessors and other integral circuits) and interconnections such that the flex circuit 100 may (1) take in signal and power from various external sources via the i/O connector 110, (2) process and/or re-route the signal/power within the flex circuit itself, and then (3) send out signal/power feeds through both the i/O connector 110 and the arm portion circuit traces to various external signal/power destinations (e.g., solenoid inputs, electric motor contacts, spark plugs, ignition coils, glow plugs, EFIs, etc.) to control the operation of the powertrain.

Figure 6A:
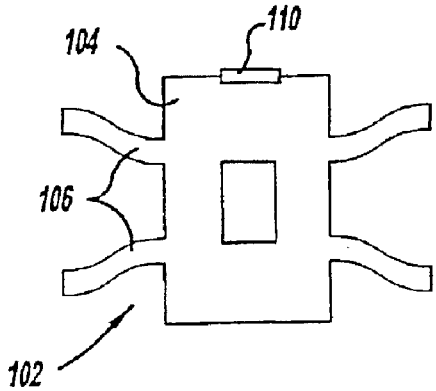
FIGS. 6*a*–6*c* are top views of another embodiment of the present invention.
Figure 6B:
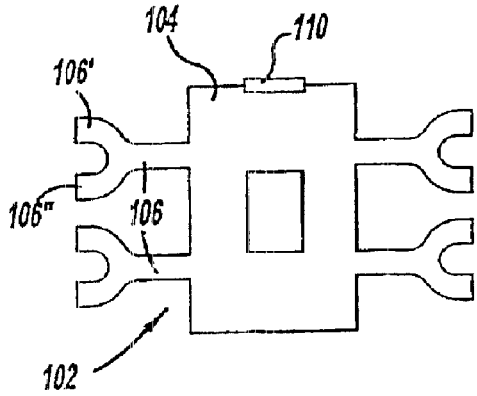
Figure 6C:
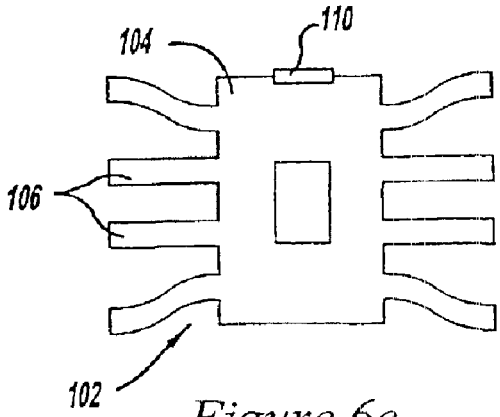

Many possible configurations exist for the present embodiment, as illustrated in FIGS. 6*a–c* for an engine having four cylinders (i.e., n=4). In a first example, as shown in FIG. 6*a*, the substrate 102 may have exactly four arm portions 106 (i.e., one for each cylinder) wherein the circuit traces (not shown) on or within each arm portion 106 have terminations capable of electrical connection with an ignition coil, an EFI, a spark plug, and/or a glow plug associated with the respective cylinder of each arm portion 106. Here, each arm portion 106 may generally conform in shape with a top runner surface 54 associated with the respective cylinder; the arm portions may then be laid atop (and optionally attached to) their respective runners and covered with a cover 112 corresponding in overall shape with the body and arm portions 104/106 as laid out atop the manifold 52 and runners 54. In a second example, as shown in FIG. 4*b*, the substrate 102 may have exactly four arm portions 106 with each arm dividing further into first and second branches 106'/106". In this case, circuit traces (not shown) on or within each first branch 106' have terminations (e.g., male plug connectors or female socket connectors) capable of electrical connection with an ignition coil, while circuit traces on or within each second branch 106" have terminations capable of electrical connection with an EFI. In a third example, as shown in FIG. 6*c*, the substrate 102 has 2*n* arm portions 106, wherein circuit traces proximate each arm portion 106 have terminations electrically connectable with one of an ignition coil, an EFI, a spark plug, and a glow plug. Many other configurations are also possible within the scope of the present invention. In any case, generally, the flex circuit substrate 102 may be draped and optionally attached onto the top surface 52 of the manifold 50, and a cover 112 as described above may then be placed over the flex circuit 102 and attached to the manifold 50.

Figure 1:
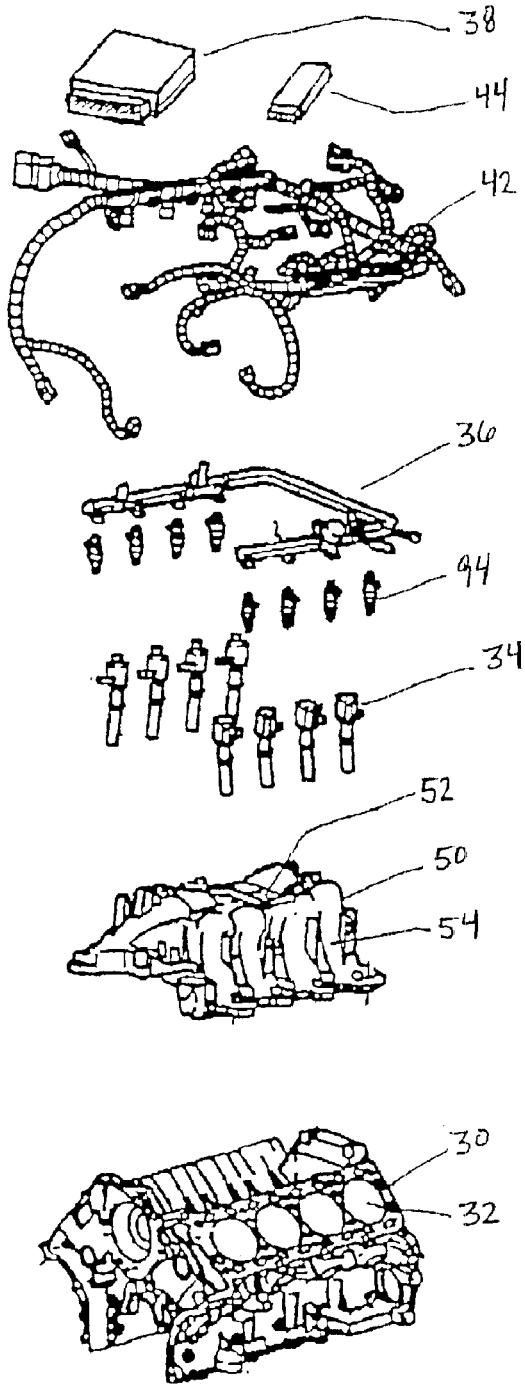
Figure 1 PRIOR ART
FIGS. 1–2 are exploded and top views of conventional engine air intake and electrical control systems.
Figure 2:
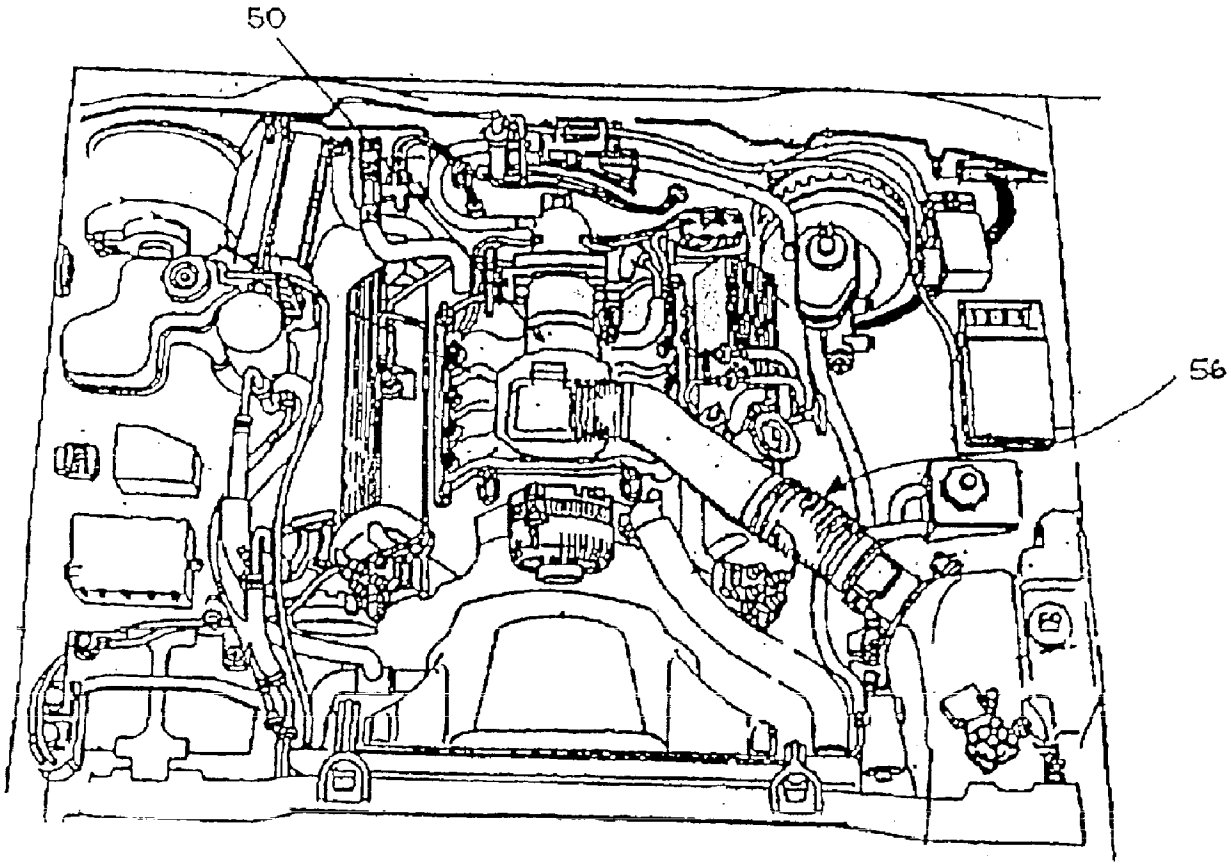
Figure 2 PRIOR ART
Figure 7:
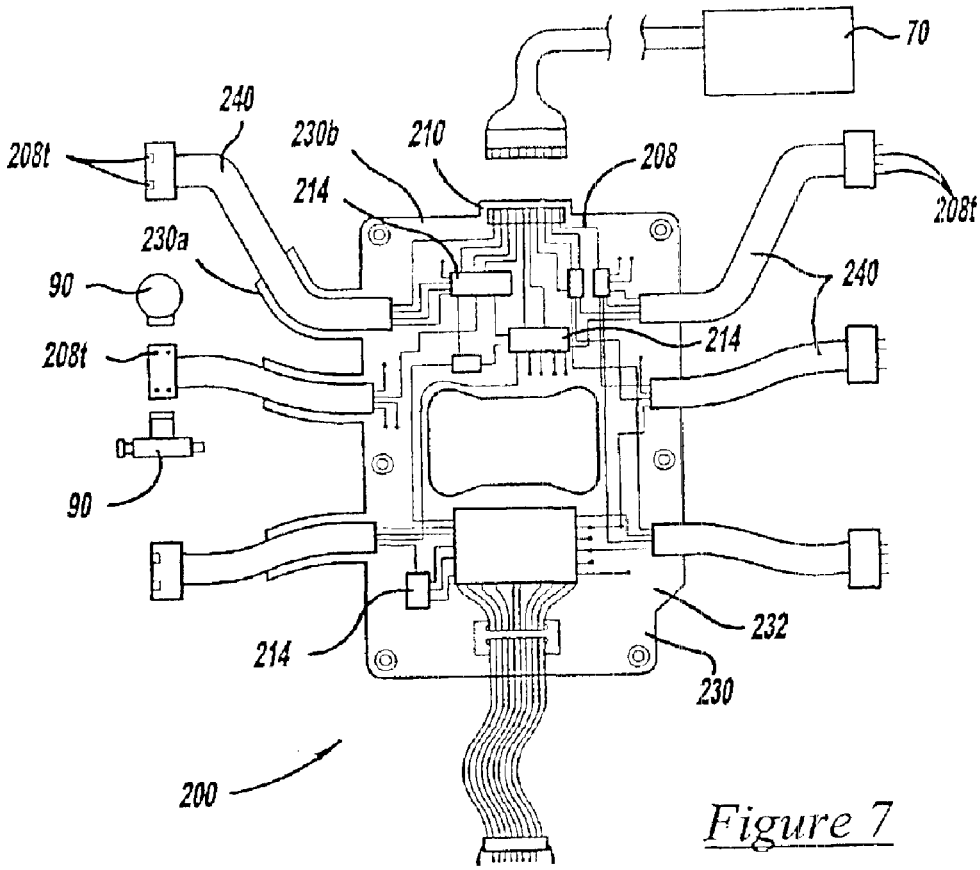
FIGS. 7–9 are top view of other embodiments of the present invention.
Figure 8:
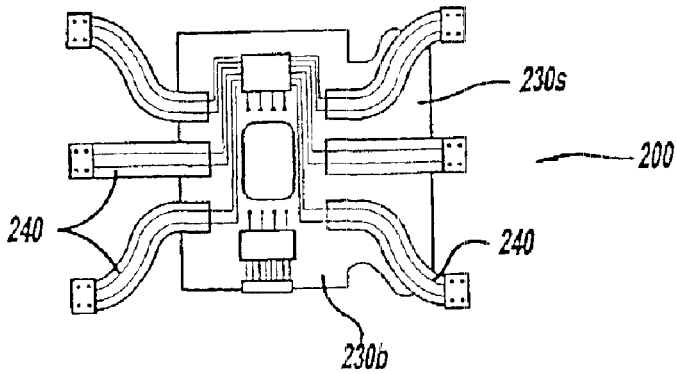
Figure 9:
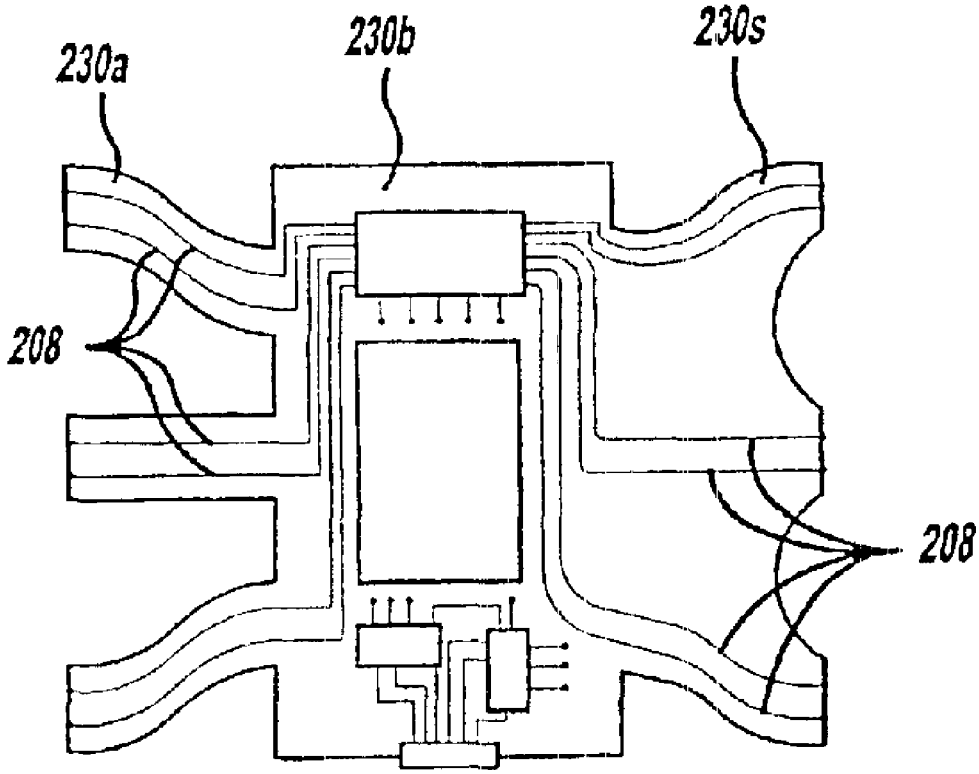

Another embodiment of the present invention relates to an intake manifold cover 200 for routing electrical signals for controlling a powertrain, wherein the powertrain has an internal combustion engine 30 having n cylinders and an intake manifold 50, as shown in FIGS. 7–9. This embodiment includes: (1) a generally rigid housing 230 generally conforming in shape with and being removably attachable to a top surface 52 of the intake manifold 50 (as shown in FIG. 2); (2) at least n carrier members 240 attached to the housing 230 and extending outward therefrom, wherein each carrier member is arranged in general proximity with a respective engine cylinder; (3) a plurality of conductive circuit traces 208 arranged on or beneath a surface 232 of the housing 230 and on or within each carrier member 240; and (4) at least one input/output connector 210 for connection to at least one of an external signal source, an external power source, an external signal destination, and an external power destination (designated collectively by reference numeral 70), wherein each input/output connector 210 is attached to the housing 230 and is electrically connected to at least one of the circuit traces 208. In embodiment 200, each circuit trace 208 carried by each carrier member 240 terminates in a termination 208*t* capable of electrical connection with at least one electrical engine element 90, such as an ignition coil, an EFI, a spark plug, and/or a glow plug.

Embodiment 200 combines many of the features of flex substrate 102 and cover 112 of embodiment 100, but is not a mere combination of these two elements. For example, whereas the first embodiment 100 includes a flex circuit substrate 102, the present embodiment 200 does not necessarily include a flex substrate. Instead, the traces 208 (and electronic components 214 such as integrated circuits and microprocessors operably connected thereto) of the present embodiment 200 may be directly connected to a surface 232 (preferably an underside surface) of the housing 230, thereby eliminating the need for a flex substrate. Of course, a flex substrate (and/or even a rigid substrate or substrate portion) may be included if desired; for example, the traces 208 and electronic components 214 may be attached to a flex circuit substrate, with this substrate then being attached to the underside or other surface 232 of the housing 230, or a flex circuit substrate may first be attached to the underside or other surface 232 and then the traces/components 208/214 attached thereto.

The generally rigid housing 230 may be (and preferably is) somewhat flexible. It is described as being "generally" rigid in that it should be able to generally maintain its shape when being handled (e.g., during manufacture and installation), but should have some inherent flexibility, as is the case with most thermoformed plastic parts, for example.

Like embodiment 100, embodiment 200 may assume many different but related configurations. For example, as shown in FIG. 7, each carrier member 240 may be an electrically insulative flexible substrate which carries the one or more circuit traces 208 thereon or therein. The flex substrate material in this case may be a flexible elastomer, such as silicone, or may be made of polyester, polyetherimide, or other suitable materials. These carrier members 240 may be attached to a lateral edge and/or to an underside or other surface of the housing 230 by adhesives, mechanical fasteners, in-molding, etc., and serve to carry signal/power between at least the i/O connector 210 and an electrical engine element 90 such as an ignition coil, EFI, spark plug, and/or glow plug. For example, each carrier member 240 may serve to carry signals/power from the i/O 210 and/or optional electronics 214 to an ignition coil and/or an EFI associated with the carrier member's respective cylinder.

The housing 230 may comprise a body portion 230*b* and at least n arm portions 230*a* extending outward from the body portion, wherein the body portion generally conforms in shape with top surface 52 of manifold 50, and wherein each arm portion 230*a* is arranged in general proximity with a respective cylinder, as shown on the left-hand side of the cover shown in FIG. 7. Alternatively, the housing 230 may comprise a body portion 230*b* as just described and at least one shroud portion 230*s* extending outward from the body portion on one or both lateral edges of the body portion, as shown on the right-hand side of the cover shown in FIG. 8. In either of these two housing configurations, the arm portions/shroud portions 230*a*/230*s* are preferably made integral with the body portion 230*s*, thus constituting a single piece which can be easily molded. In these two configurations each carrier member 240 is preferably attached to a corresponding arm portion 230*a* or shroud portion 230*s*, but may alternatively be attached to the body portion 230*b*.

Each carrier member 240 and/or (if provided) each arm portion 230*a* may be constructed so as to generally conform to each respective cylinder thereof. Alternatively, rather than providing separate but geometrically similar arm portions 230*a* and carrier members 240, the features of both may be combined to comprise a configuration wherein each carrier member 240 is an outwardly extending integral arm portion of the housing 230. That is, rather than having carrier members which carry circuit traces thereon or therein attached to separate, corresponding arm portions 230*a* or shroud portions 230*s*, instead the circuit traces could be carried on or within an underside (or other) surface of each arm or shroud portion 230*a*/230*s*—each arm/shroud portion would both extend outward from the body portion 230*b* and serve as a carrier for the circuit traces 208 associated with the arm portion and respective cylinder, as illustrated in FIG. 9.

Figure 10:
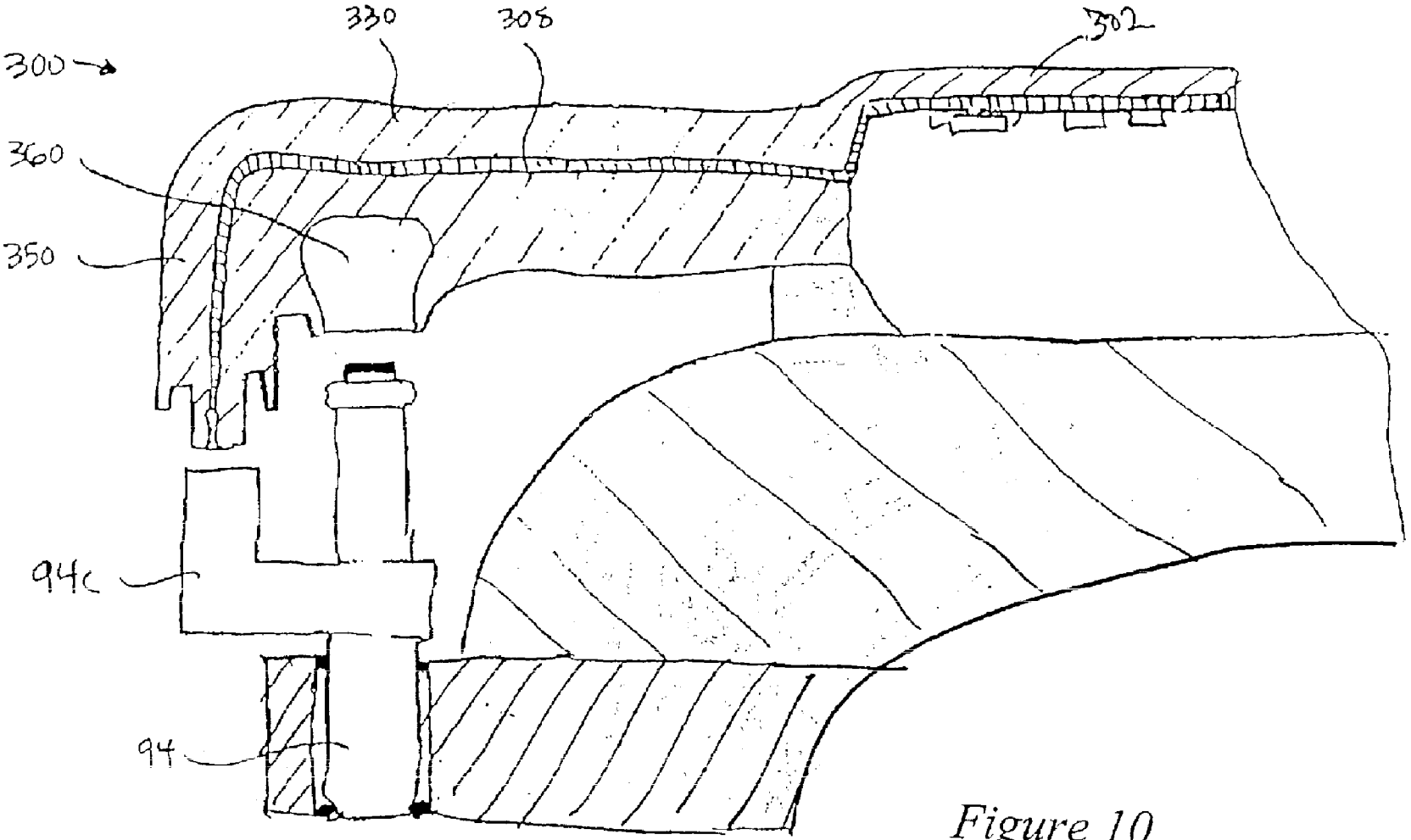
FIG. 10 is a sectional side view of an intake manifold having an integrated powertrain control module housing attached thereto, in accordance with an embodiment of the present invention.

Yet in another embodiment 300 of the present invention, an intake manifold cover 302 is illustrated in cross section in FIG. 10, and includes: (1) a generally rigid housing 330 generally conforming in shape with and being removably attachable to top surface 52 of intake manifold 50, the housing 330 extending generally over each cylinder; (2) a plurality of conductive circuit traces 308 arranged on or within an underside or other surface of the housing and extending in general proximity with each cylinder; (3) at least one input/output connector for connection to at least one of an external signal source, an external power source, an external signal destination, and an external power destination, wherein each input/output connector is attached to housing 330 and is electrically connected to at least one of the circuit traces 308; and (4) at least n electrical connectors 350 in-molded in housing 330, wherein each connector 350 is connected with at least one of the circuit traces 308 and is disposed within housing 330 so as to be directly connectable with an electrical engine element, such as an electronic fuel injector 94, when housing 330 is attached to intake manifold 50. The housing portion(s) which extend over each cylinder may comprise integral arm or shroud portions, similar to FIG. 9.

As shown in FIG. 10, intake manifold cover 302 may further comprise at least one fuel rail 360 integral with the housing 330, wherein each fuel rail is directly and sealably connectable with at least one electronic fuel injector 94 so as to provide sealable fluid communication between the fuel rail and each EFI connectable thereto. Preferably, the cover 302 is made of molded plastic and includes either one fuel rail 360 for slant-type or in-line engines or two fuel rails 360 for V-type engines. The fuel rail(s) 360 may be conventional metal fuel rails that are insert molded into the housing 330, or (as shown in FIG. 10) may be metallized or non-metallized channels formed within the housing 330 by lost-core or other molding processes.

Manifold cover 302 of the present embodiment may include n electrical connectors 350 disposed within the housing 330. Each connector 350 is directly connectable with a mating electrical connector portion 94*c* of an associated electronic fuel injector 94 when the housing 330 is placed atop and attached to the intake manifold 50, for example.

At least a subset of the circuit traces 308 may be in-molded within the housing 330 and may comprise a metal stamping, a flex circuit, or a network of wires within the housing. Preferably this subset of traces are each operably connected with the at least n electrical connectors 350.

One advantage of the present embodiment is that the cover 300 may be fitted over and attached to the manifold 50 with the aforementioned electrical connectors 350 fitting directly over their respective electrical engine elements 90. For example, a cover may have connectors 350 in-molded therein which may simultaneously mate directly with the mating electrical connector portions of n ignition coils and n fuel injectors when the cover is lowered onto and attached to the manifold 50, without requiring additional steps or interconnecting components (e.g., wire harnesses or cables) for connecting the coils and EFIs with their power/signal sources. Adding the fuel rails 360 as described above further reduces complexity and installation effort.

Figure 11:
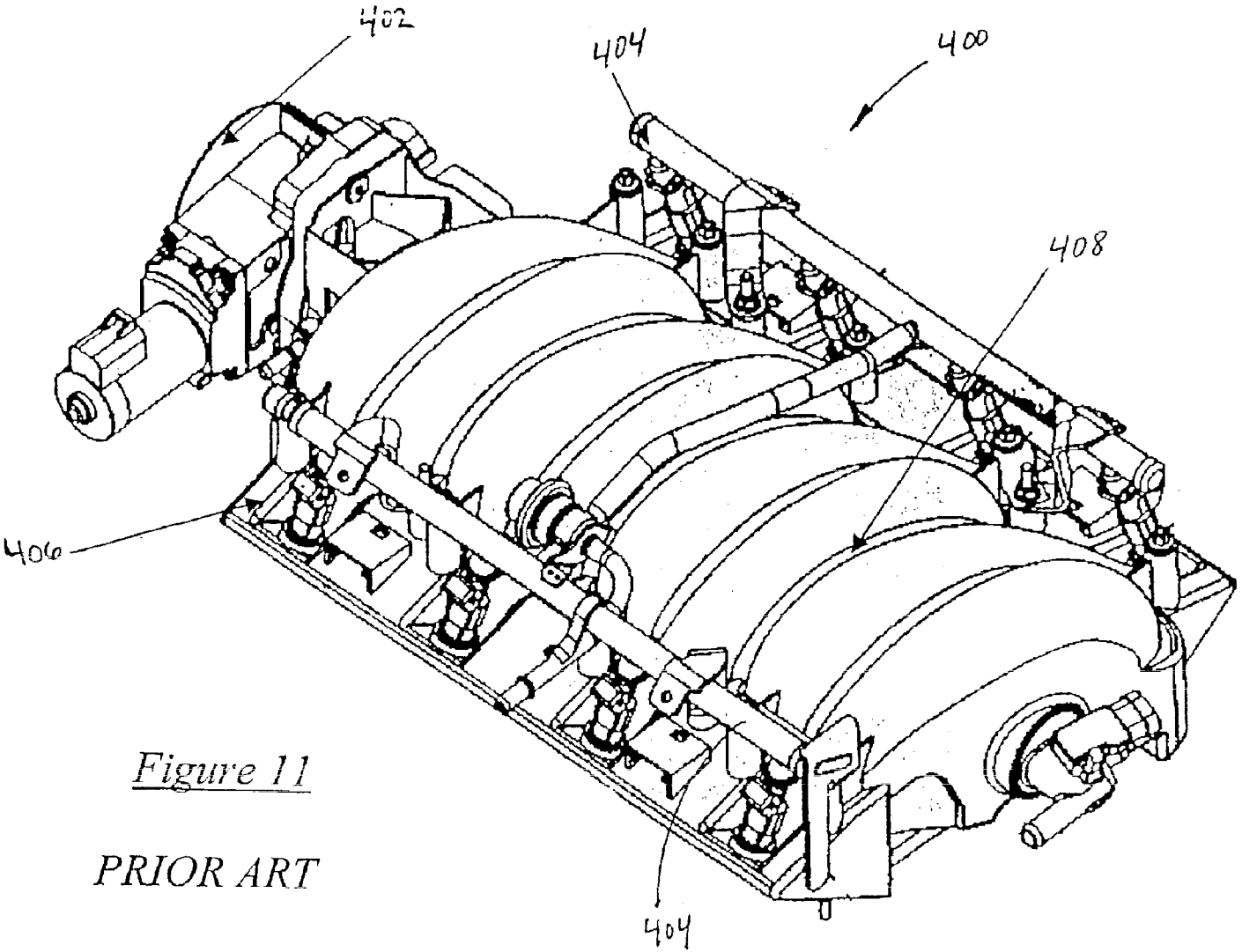
Figure 11 PRIOR ART
FIG. 11 is a perspective view of a conventional air intake manifold and throttle body.

Referring now to FIG. 11, a conventional air intake manifold 400 is illustrated. As is well know in the art, air intake manifold 400 includes a throttle body 402 fuel rails 404 and a plurality of fuel injectors affixed to a manifold housing 408. Preferably, manifold housing 408 is comprised of a light weight plastic. Air intake manifold assembly 400 conventionally provides the proper air fuel mixture to the cylinders of a vehicle engine. The electronically controlled fuel injectors and coils as well as electrical supply to throttle body 402 and other sensors and valves coupled to housing 408 interconnect to a manifold wire harness (not shown) in a conventional manner. In operation, outside air is drawn into manifold housing 408 and is directed into various air ducts and passages (not shown) to the plurality of engine cylinders.

Figure 12A:
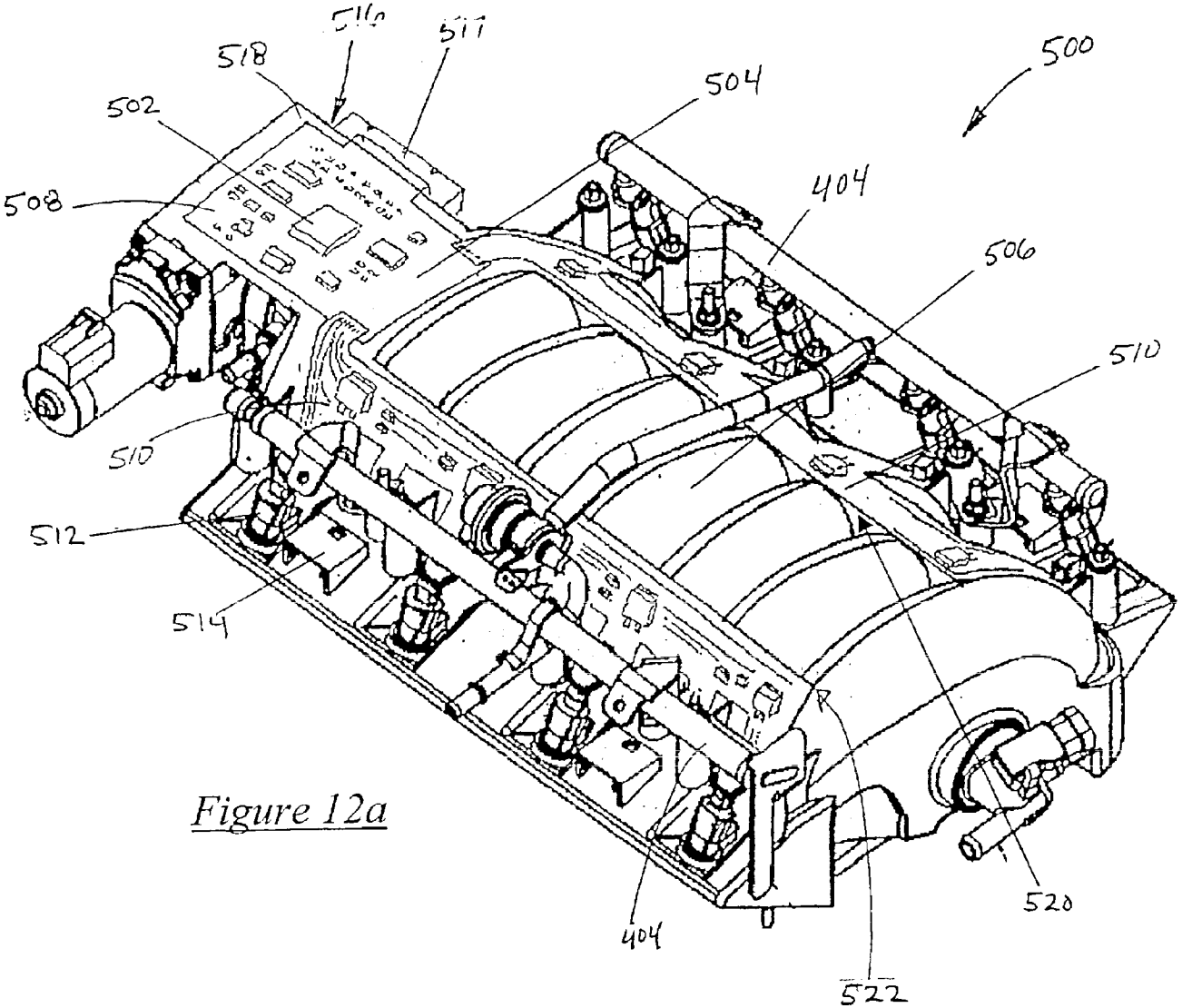
FIG. 12*a–c* are perspective views of embodiments of the present invention secured to air intake manifolds.
Figure 12B:
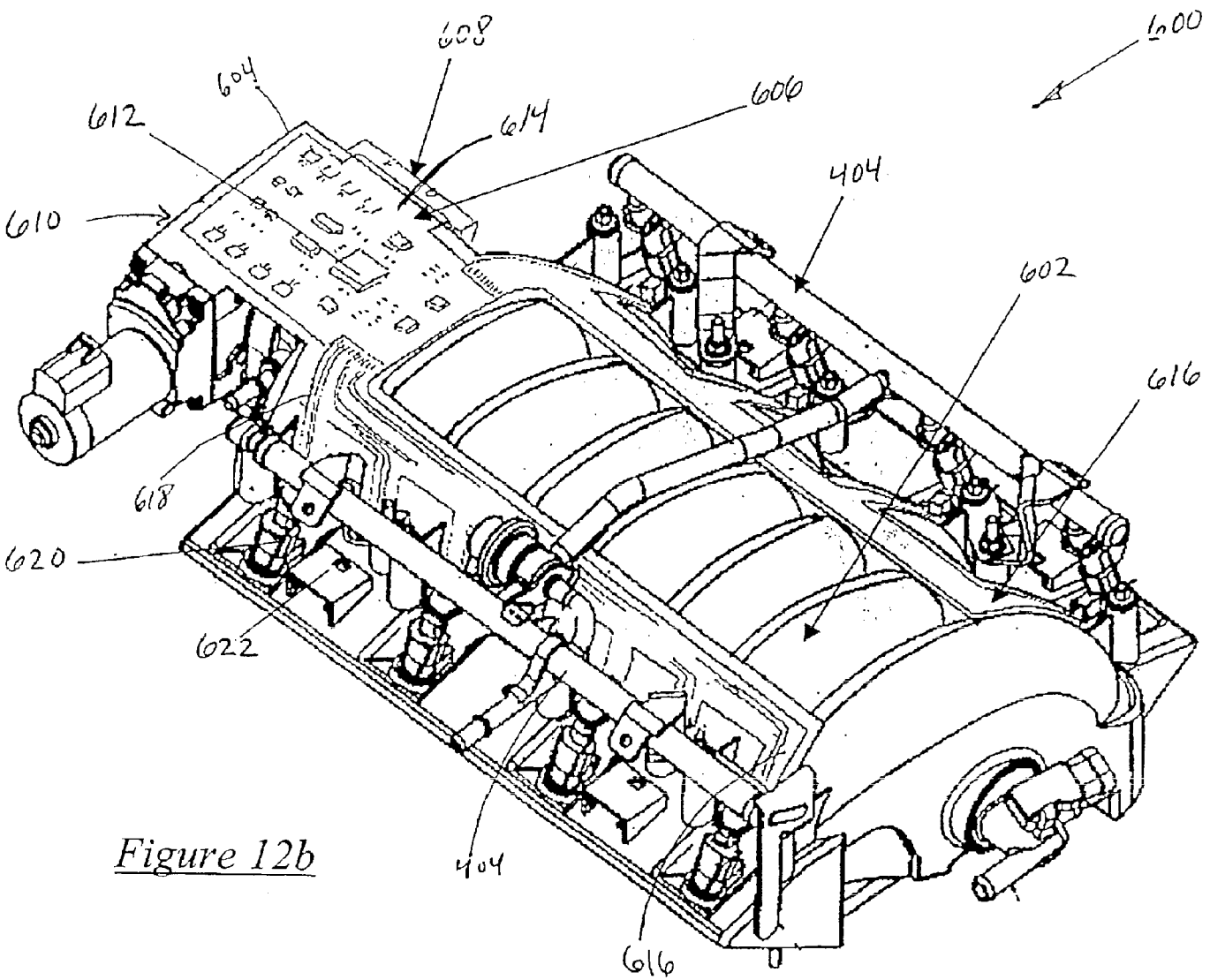
Figure 12C:
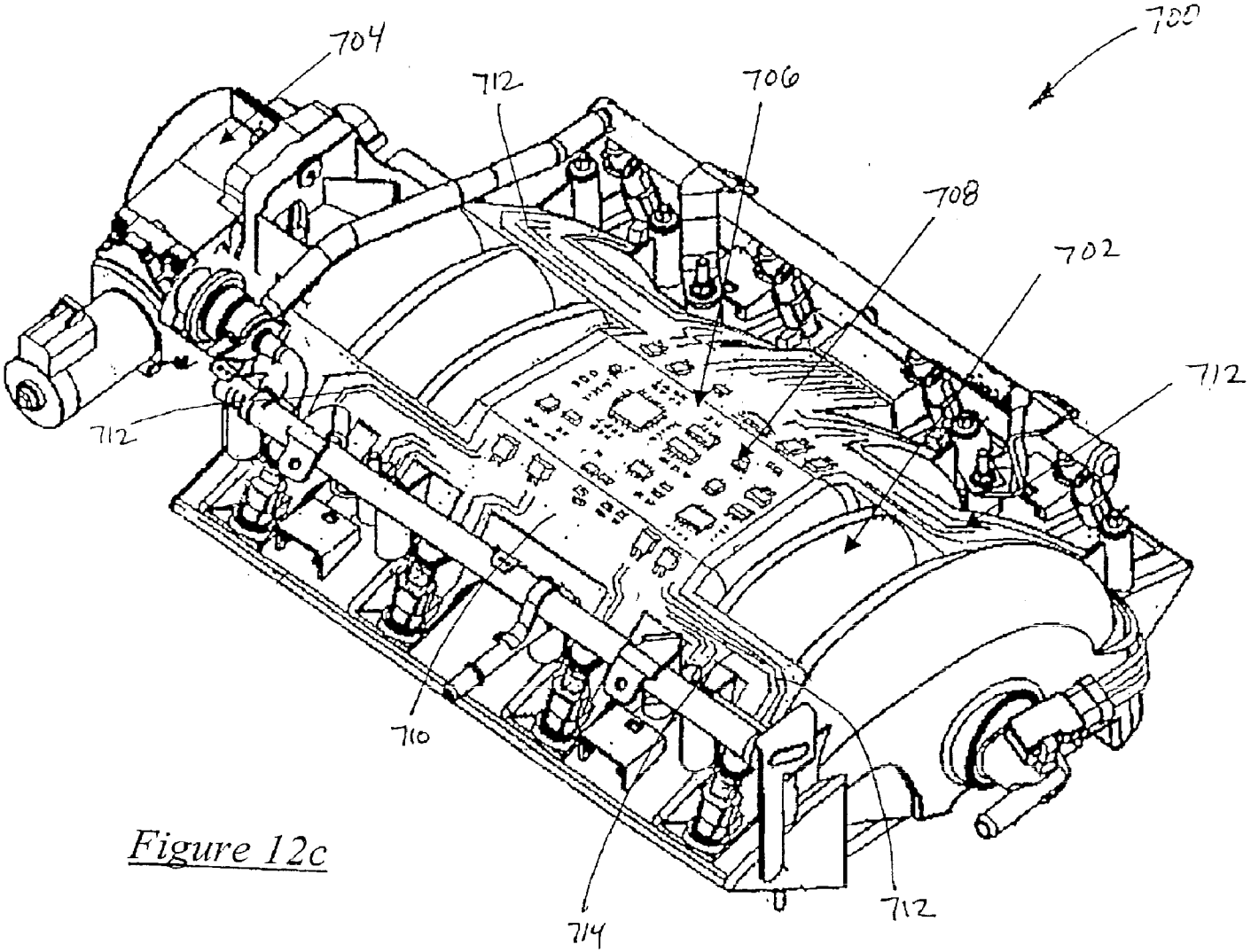

Referring now to FIGS. 12*a* through 12*c*, preferred embodiments of an integrated electronic powertrain control manifold are illustrated, in accordance with the present invention. Specifically, FIG. 12*a* illustrates an integrated electronic manifold assembly 500 having powertrain control electronics 502 mounted to an electronic substrate 504 coupled to a manifold housing 506. Control electronics 502 include integrated circuits, memory chips (such as only memory and random access memory), logic devices, programmable logic devices, microprocessors, discrete electrically components and like devices. Substrate 504 includes a main portion 508 and runner portions 510. Generally, powertrain control electronic are located substantially on the main portion 508, however additional electronic circuits and components may be disposed along runner portions 510. Runner portions 510 interconnect various electrical devices such as fuel injectors 512 and coil interconnects 514, as well as other sensors and electrical devices disposed on or adjacent to manifold housing 506.

Main portion 508 is preferably affixed to throttle body 516 having a surface 518 adaptive to receive substrate 504. Surface 518 of throttle body 516 includes a heatsink 517 for drawing thermal energy emitted by electrical components 502. Thus, the present invention provides a system for cooling the powertrain control electronics to prevent over heating. Manifold housing 506 further includes support surfaces 520 extending longitudinally along a top surface 522 of manifold housing 506. Support surfaces 520 are adapted to carry runners 510 populated with control electronics.

An alternate embodiment of an integrated electronic manifold assembly is generally indicated by reference numeral 600, as illustrated in FIG. 12*b*. Assembly 600 includes a manifold housing 602 coupled to a throttle body 604. In the present embodiment, an electronic substrate 606 is mounted to the throttle body 604 over a throttle body heatsink surface 608. Heatsink surface 608 is generally formed from the throttle body housing 610 typically made of a thermally conductive material. Substrate 606 is configured to receive electronic components such as integrated circuits, logic devices, analog and digital circuits, memory modules, and discrete components and to operatively interconnect these components to provide electrical communication therebetween. For example, substrate 606 includes control electronics and circuitry 612 for controlling the operation of a vehicle powertrain. In the present embodiment, substrate 606 includes a main substrate portion 614 which contains all of the electronic devices used to control a vehicle powertrain. Additionally, substrate 606 includes runner portions 616 containing electrical circuit traces 618 for communicating electrical signals to and from control circuitry 612 in various electrical components and devices such as fuel injectors 620 and interconnects to coils 622 for example. Thus, the present embodiment provides a centrally located powertrain control circuitry and eliminates remotely located electronic devices and components which may be desirable in particular vehicle environments.

Referring now to FIG. 12*c*, yet another embodiment of the integrated electronic manifold assembly of the present invention is illustrated. Integrated electronic air intake manifold assembly 700 is shown having a manifold housing 702 coupled to a throttle body 704. As in previous embodiments, a substrate 706 is provided for receiving electronic control circuitry and components 708 for controlling the operation of a vehicle powertrain. Substrate 706 includes a main portion 710 and runner portions 712. A heat sink surface is provided underneath substrate 706 and in thermal communication with manifold housing 702. Thus, substrate 706 and electronic circuits 708 are cooled by air flowing through manifold 702. Main portion 710 includes substantially all of the electronic components and circuitry while runner portions 712 generally contain circuit traces 714 for communicating electrical signals to and from main portion 710 and various electrical devices. Such devices include, for example, fuel injectors, coils, valves, switches and the like.

Various other modifications to the present invention will, no doubt, occur to those skilled in the art to which the present invention pertains. For example, although only V-type engines are shown in the drawings, the present invention also relates to slant-type engines, in-line engines, rotary engines, etc. It should also be understood that the present invention relates to both gasoline and diesel internal combustion engines, as well as to hybrid electric/internal combustion engines. The present invention applies to engines using spark plugs, glow plugs, or compression-ignition-only; to those having carburetors, EFIs, or other related systems; and to systems. Furthermore, while the arm portions, shroud portions, and carrier members have been described above as being connected to or integral with a cover, housing, or body portion, it is within the scope of the present invention that the arm portions, runner portions, shroud portions, and carrier members may be removably connectable with their associated cover, housing, or body portion, such as by using mating male/female electrical connectors. Also, the housing or cover may include louvers, vanes, and the like for directing some amount of air from the air intake duct across the circuit traces and optional electronic components, so as to assist in cooling these elements during operation. Moreover, it should be understood that while the arm portions, runner portions and carrier members have variously been described as being connected to ignition coils, EFIs, spark plugs, and glow plugs, it is contemplated that other electrical engine elements may be used instead of or in addition to these four highlighted elements, such as engine sensors, climate sensors, solenoids, switches, etc., whether sending or receiving signals to or from the present invention.

Additionally, it should be understood that the use of the word "signal" as variously used herein may encompass both relatively low voltage/low amperage triggering signals and relatively high voltage/high amperage power feeds, whether sent/received in intermittent pulses or in continuous non-pulsed form. Finally, the present invention further includes a flex circuit similar to the above described embodiments, but which has no arm portions, or less than n arm portions, and which may not necessarily include any element which is generally proximate to or related with any engine cylinder. It is the following claims, including all equivalents, which define the scope of the present invention.

What is claimed is:

1. A circuit for routing electrical signals in an internal combustion engine, the circuit comprising:

a main circuit portion formed in a throttle body of an air induction system of the internal combustion engine;

a plurality of circuit runner portions extending from the main circuit portion for interconnecting the main circuit portion with a plurality of engine components; and a heat sink fixable to the throttle body and in contact with the main circuit portion and the plurality of circuit runner portions for dissipating heat generated in the circuit portions.

2. The circuit of claim 1 wherein the heat sink is comprised of a thermally conductive material.

3. The circuit of claim 1 wherein the main circuit portion further comprises a flexible substrate for supporting electrical conductors and electrical devices.

4. The circuit of claim 1 wherein the main circuit portion further comprises a flexible substrate and a rigid substrate for supporting electrical conductors and electrical devices.

5. The circuit of claim 1 further comprising a plurality of electrical conductors and a plurality of electrical devices wherein the plurality of electrical devices are mounted on the main circuit portion and the plurality of electrical conductors are affixed to the main circuit portion and the plurality of circuit runner portions.

6. The circuit of claim 1 further comprising a plurality of electrical conductors and a plurality of electrical devices wherein the plurality of electrical devices and the plurality of electrical conductors are mounted throughout the main circuit portion and the plurality of circuit runner portions.

* * * * *